US006913341B2

(12) United States Patent
Barinaga et al.

(10) Patent No.: US 6,913,341 B2
(45) **Date of Patent: *Jul. 5, 2005**

(54) SERVICE STATION ARCHITECTURE AND METHOD FOR DRUM PRINTER

(75) Inventors: John A. Barinaga, Portland, OR (US); Geoff Wotton, Battleground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 71 days.

This patent is subject to a terminal disclaimer.

(21) Appl. No.: 10/631,903

(22) Filed: Jul. 31, 2003

(65) Prior Publication Data

US 2005/0024421 A1 Feb. 3, 2005

(51) Int. Cl.[7] ..... B41J 2/165

(52) U.S. Cl. ..... 347/29; 347/30; 347/32; 347/33

(58) Field of Search ..... 347/22–35; 101/116

(56) References Cited

U.S. PATENT DOCUMENTS

| | | | | |
|---|---|---|---|---|
| 5,184,147 A | | 2/1993 | MacLane et al. | |
| 5,534,897 A | * | 7/1996 | Anderson et al. | 347/32 |
| 6,154,232 A | | 11/2000 | Hickman et al. | |
| 6,276,268 B1 | | 8/2001 | Takahashi et al. | |
| 6,585,347 B1 | * | 7/2003 | Johnson et al. | 347/22 |

* cited by examiner

*Primary Examiner*—Shih-Wen Hsieh

(57) ABSTRACT

Techniques are disclosed for servicing a printhead. In one exemplary technique, the printhead is moved along a path away from a printing position adjacent a drum to a service position away from the drum. A service operation is conducted on the printhead at the service position. The printhead is then moved back to the printing position to reposition the printhead adjacent the drum.

44 Claims, 6 Drawing Sheets

SERVICE STATION ARCHITECTURE AND METHOD FOR DRUM PRINTER

BACKGROUND

Drum printers are a type of printing system including a rotating drum for moving media under a printing device such as an array of fluid ejecting elements. The fluid ejecting elements can include inkjet printheads, and typically may need servicing from time to time. Accessing the printheads for servicing presents a problem.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION OF THE DISCLOSURE

Figure 1:
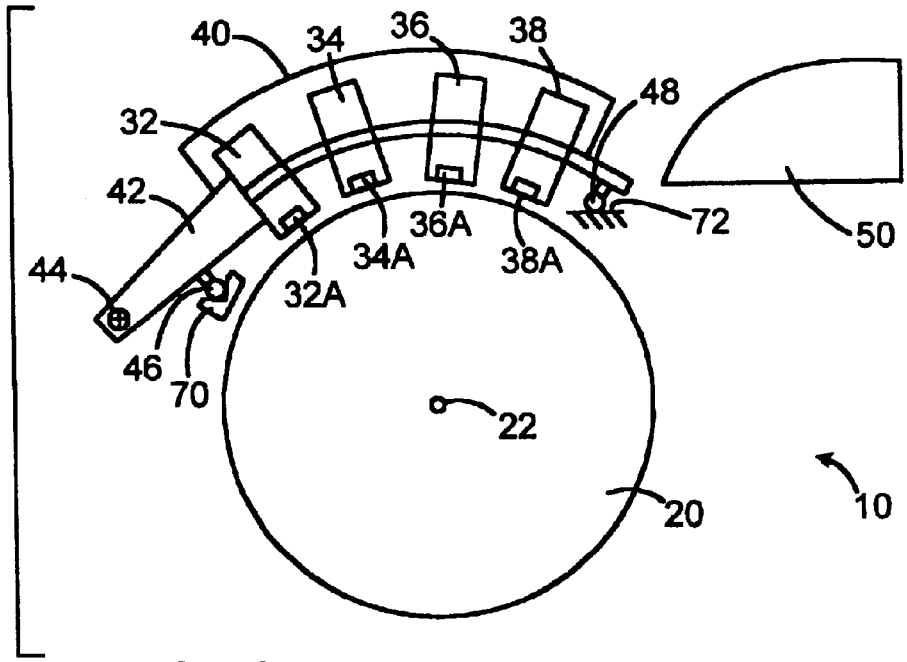
FIG. 1 is a schematic illustration of an exemplary embodiment of a drum printer employing a service station, with the print bars in printing positions.

In the following detailed description and in the several figures of the drawing, like elements are identified with like reference numerals.

FIG. 1 is a schematic illustration of an exemplary embodiment of a drum printer 10 comprising a rotating drum 20, with a plurality of print bars 32, 34, 36, 38 disposed above the drum. The drum 20 is mounted for rotation about a drum center axis 22. Each print bar comprises in this exemplary embodiment a page wide array (PWA) 32A, 34A, 36A, 38A of printheads or pens. In this exemplary embodiment the printheads are inkjet printheads, each comprising one or more arrays of fluid ejecting nozzles. In an exemplary embodiment, each print bar supports a plurality of printheads, disposed along the width of the page. Moreover, each print bar can support printheads of the same color in an exemplary embodiment. For example, printhead array 32A can be yellow ink ejection devices, printhead array 34(A) can be black ink ejection devices, printhead array 36(A) can be cyan ink ejection devices, and printhead array 38(A) can be magenta ink ejection devices. In another embodiment, a print bar can have printheads with multiple colors of ink.

Figure 2:
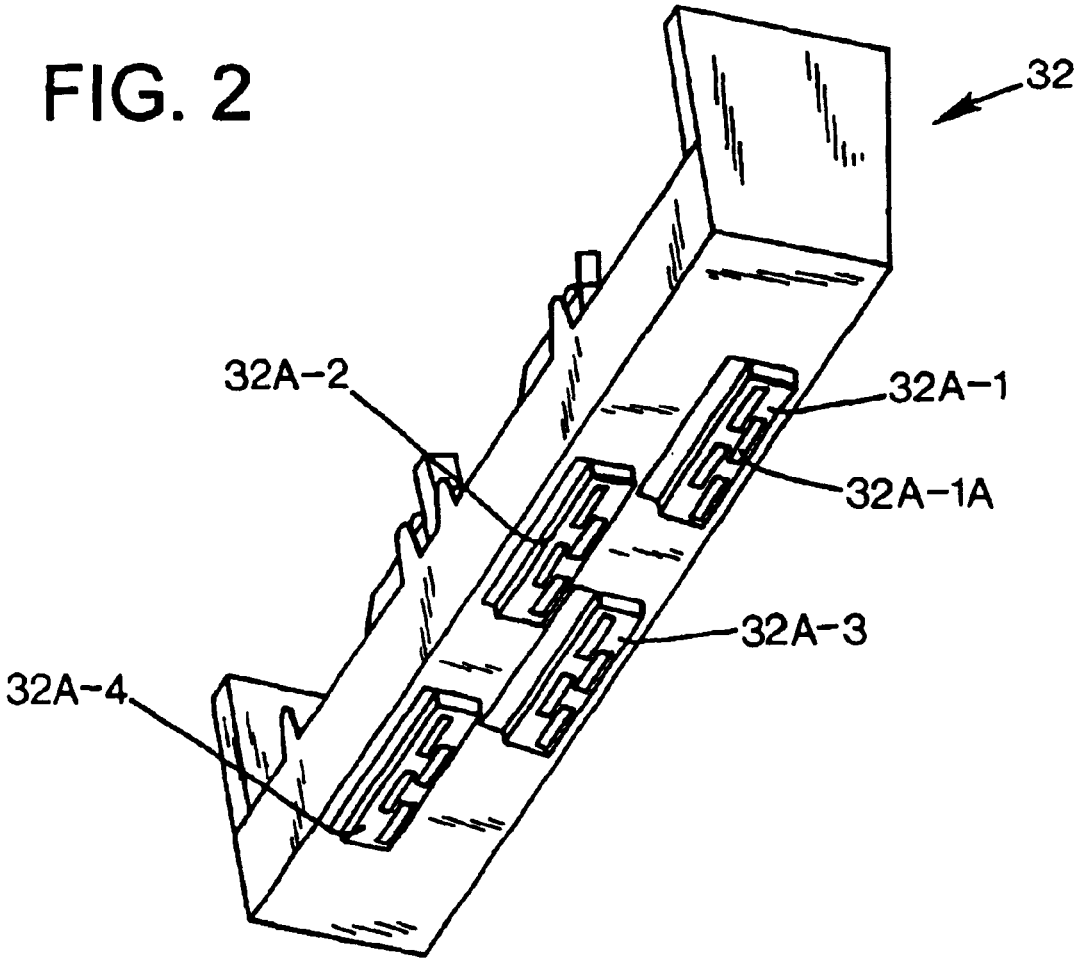
FIG. 2 is an isometric view of an exemplary print bar.

FIG. 2 is an isometric view of an exemplary print bar 32, which has mounted therein four printhead cartridges or modules 32A-1, 32A-2, 32A-3, 32A-4, each with an associated printhead nozzle array. In this exemplary embodiment, each cartridge includes a set of four nozzle arrays which are arranged in a staggered relationship. For example, printhead 32A-1 includes an array 32A-1A of nozzle arrays. The printhead cartridges are arranged along an extent of the print bar in a distributed, staggered manner so as to provide full coverage along the extent of a print zone. In an exemplary embodiment, each of the print cartridges can be fed with ink through flexible tubes (not shown) running to ink supplies (not shown) located off the print bar. Alternatively, the print cartridge can include on-board ink reservoirs (not shown) with capacity sufficient to print one or more print jobs.

In this exemplary drum printer configuration, the printer loads the print medium onto the rotating drum, and holds the print medium tightly against the drum surface, e.g. by a vacuum system. Ink is ejected onto the surface of the print medium as it passes underneath the print bars to form the image. The print medium is unloaded off the drum after completion of the print job. The print bars are positioned with the printhead nozzle arrays very close to the surface of the drum in a printing position to provide high print quality of the printed output.

Printhead servicing is performed, e.g. to cap the nozzle arrays, wipe the arrays, actuate the printheads to eject ink into a spittoon or for drop detection. To accommodate servicing the printheads, in an exemplary embodiment, the print bars are secured in a ganged fashion to a print bar frame structure 40 comprising an pivot structure 42. In an exemplary embodiment, the frame structure 40 and the pivot structure 42 are fabricated as a single rigid structure having mounting locations for attachment of the print bars 32, 34, 36, 38. The pivot structure 42 is mounted for pivoting movement about a pivot axis 44. In this embodiment, the pivot axis 44 is parallel to the drum axis 22 of rotation. A service station 50 is provided to perform servicing on the printheads when the printheads are positioned away from the drum surface. FIG. 1 shows the print bar frame and the printheads in a printing position. Accurate positioning of the print bar frame relative to the drum surface is provided by registration surfaces 70, 72 and datums 46, 48. In one embodiment, the pivot structure 42 has some compliance about the pivot axis 44. The datums 46, 48 are ball or curved surfaces, formed on or carried by the pivot structure 42 and print bar support structure 40. The registration surface 70 is a V-block structure, which receives datum 46 in its notch with the print bar structure in the printing position. The second datum 48 fits against the surface 72. For some applications, there will be a set of fixed registration surfaces 70, 72 and datums 46, 48 on each of the opposite sides of the drum.

Figure 3:
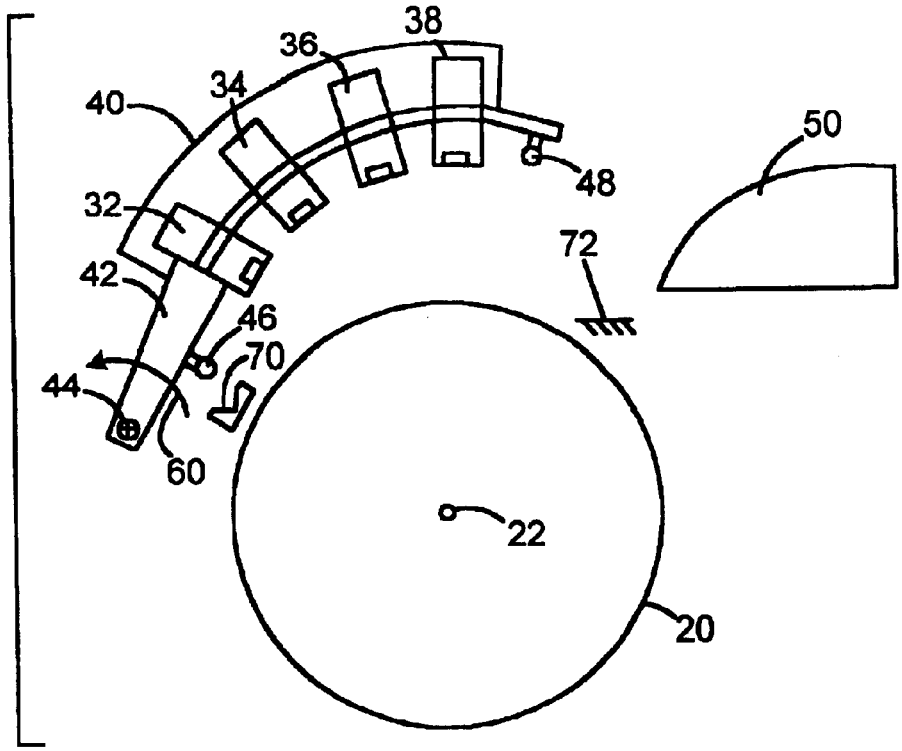
FIG. 3 is a schematic illustration of the drum printer of FIG. 1, with the print bars rotated to a service position.
Figure 4:
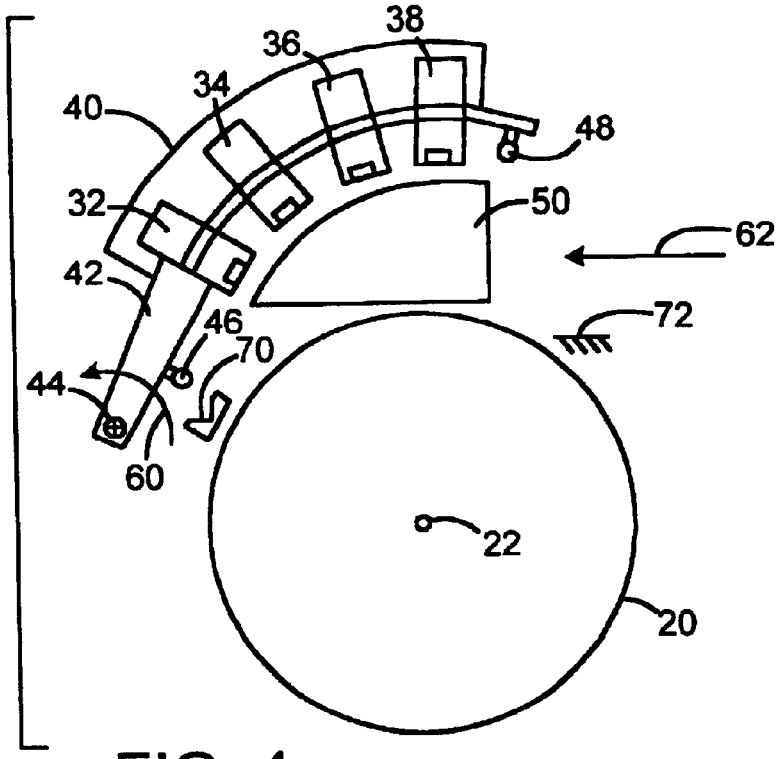
FIG. 4 is a schematic illustration of the drum printer as in FIG. 3, with the service station moved into a servicing position.

When it is time for the printheads to be serviced, the print bar frame structure 40 and the print bars 32, 34, 36, 38 are pivoted about pivot axis 44, following a constrained path 60 up and away from the drum surface to a service position that allows access to the printheads. In this embodiment, the path 60 is orthogonal to the axis 22 of rotation of the drum 20. In an exemplary embodiment, a pivot pin forms the pivot axis 44, and is mounted to a frame chassis (not shown); the frame structure 40 is rotatable about the pin. A motor driven gear train can be employed to move the frame structure about the pivot axis through its range of movement. FIG. 3 illustrates the print bars and frame structure 40 after they have been moved to the servicing position, with the service station 50 still in a home position. Now the service station is moved along a service path 62 (FIG. 4) which is generally orthogonal to the drum axis 22, to a servicing position. FIG. 4 shows the service station 50 after it has been moved into the servicing position. The printheads can now be serviced, e.g. wiped or capped, by the service station 50. In an exemplary embodiment, the service station 50 includes a wiper and a cap assembly for each printhead mounted on each print bar.

When the service station 50 has finished servicing the printheads, the service station is returned to the home position (FIG. 3), and the print bars are pivoted back along the constrained path 60 to the printing position (FIG. 1). The datums 46, 48 are brought against the registration surfaces 70, 72 to accurately position the print bar for printing. The datum 46 moves to the notch of the registration surface 70, and the datum 48 to the registration surface 72, under the force of gravity in this exemplary embodiment. The printer can now resume printing, and maintenance on the service station can be performed, e.g. scraping the wipers by a fixed set of scraper components.

Since in this exemplary embodiment, the print bars are moved in one axis, i.e. in a rotational path 60 about axis 44, to allow access to the printheads, re-positioning the print bars is relatively simple. The printheads should be re-positioned very accurately in order to maintain good print quality. In an exemplary embodiment, this accuracy is provided by datums 46, 48 which are positioned against the registration surfaces 70, 72.

Figure 5:
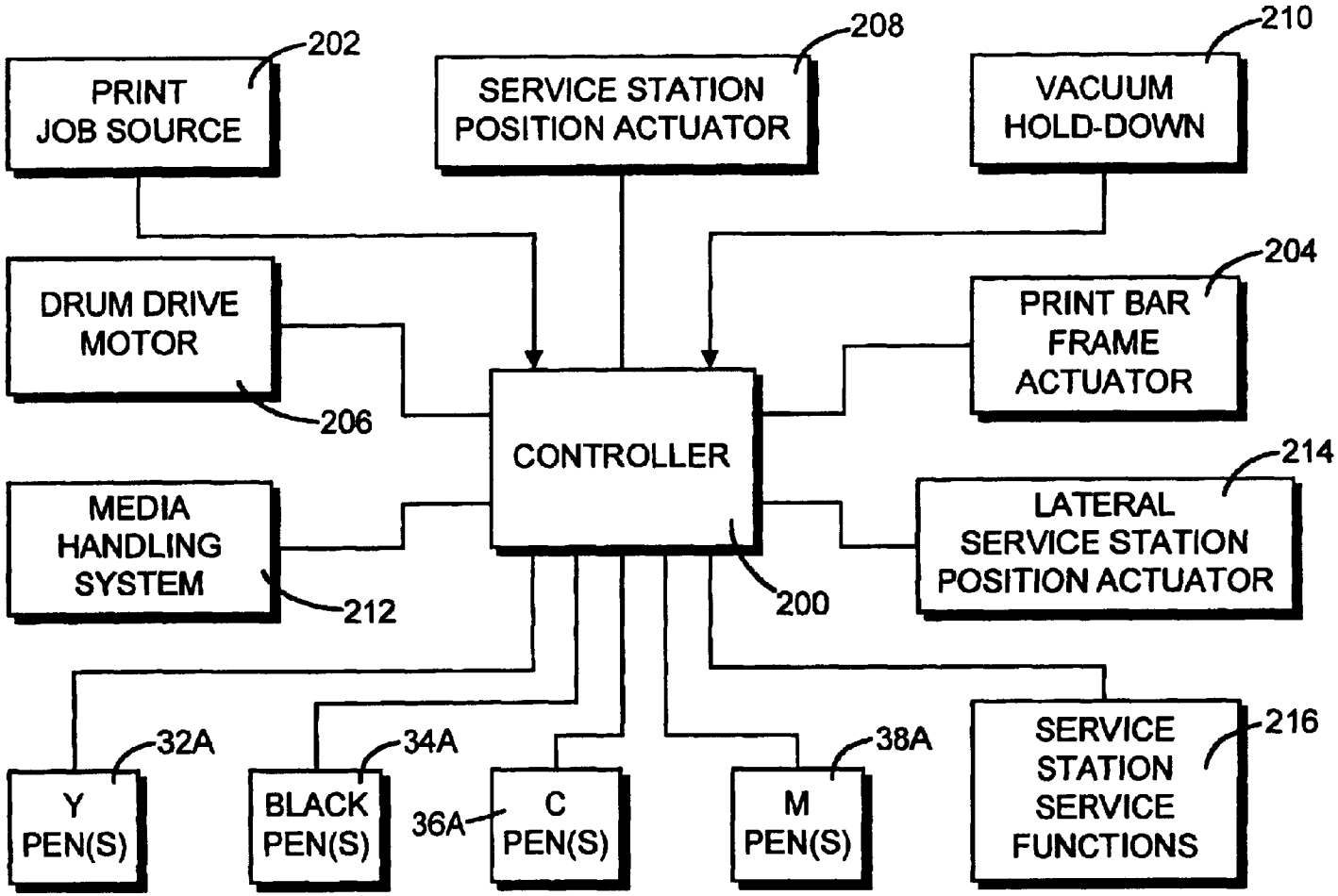
FIG. 5 is a schematic control block diagram of elements of the drum printer of FIGS. 1–4.

FIG. 5 is a schematic block diagram of the control system for the printer of FIGS. 1–4. A controller 200 such as a microcomputer or ASIC receives print job commands and data from a print job source 202, which can be a personal computer, scanner, digital camera or other known source of print jobs. The controller acts on the received commands to activate a media handling system 212 to load a print medium onto the drum 20 and activate the vacuum hold-down system 210 to hold the print medium against the drum surface. The drum drive motor 206 is commanded by the controller to position the drum 20 for commencement of a print job. Firing pulses are sent to the printheads comprising the pens 32A, 34A, 36A, 38A to eject ink droplets onto the medium surface. The controller is programmed to advance incrementally the drum past the print bars. The media handling system unloads the print medium from the drum upon completion of printing.

When it is time for a service operation, in one exemplary embodiment, a print bar frame actuator or motor 204 can be activated by the controller to rotate the print bar frame structure about pivot axis 44 from the printing position along path 60 to the service position. A service station position actuator or motor 208 can then be activated to move the service station 50 along path 62 to the service position.

Once the service station and print bar frame structure have reached their servicing positions, the controller actuates the service station functions 216, e.g. any of wiping, capping, drop detecting and spitting. In an exemplary embodiment, the service station service elements, e.g. the wipers and caps can be moved laterally, by service station lateral actuator 214 to perform wiping and capping functions. In an exemplary embodiment, the actuator 214 can be a motor driven gear train, with rack and pinion gearing. When it is time to commence printing operations, the service station is moved to the rest position, and the print bar frame structure with the print bars is returned to the printing position.

Figure 6:
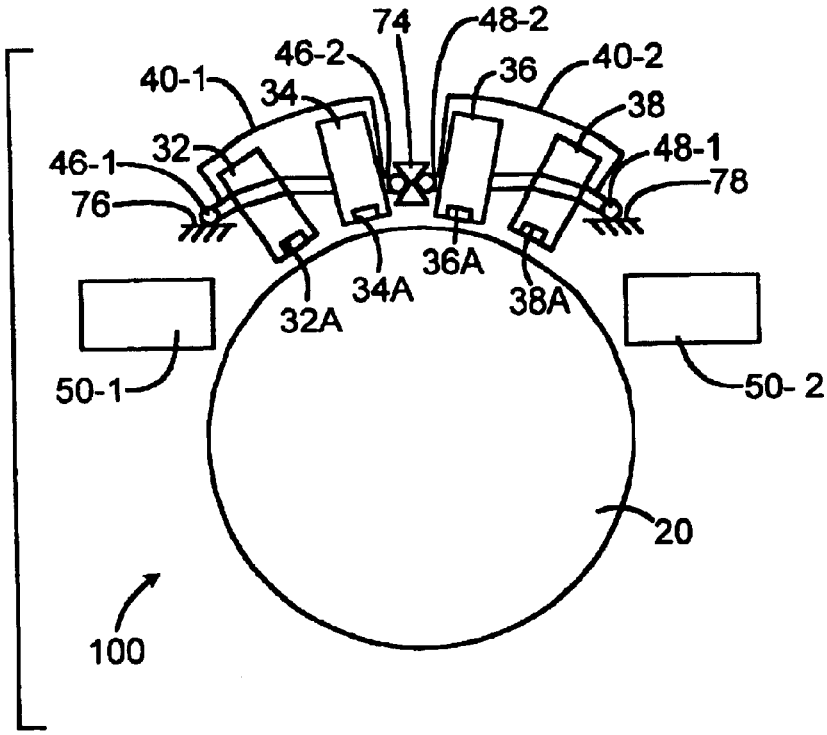
FIG. 6 is a schematic illustration of an exemplary embodiment of a printer employing a split service station architecture, with print bars in print positions.
Figure 7:
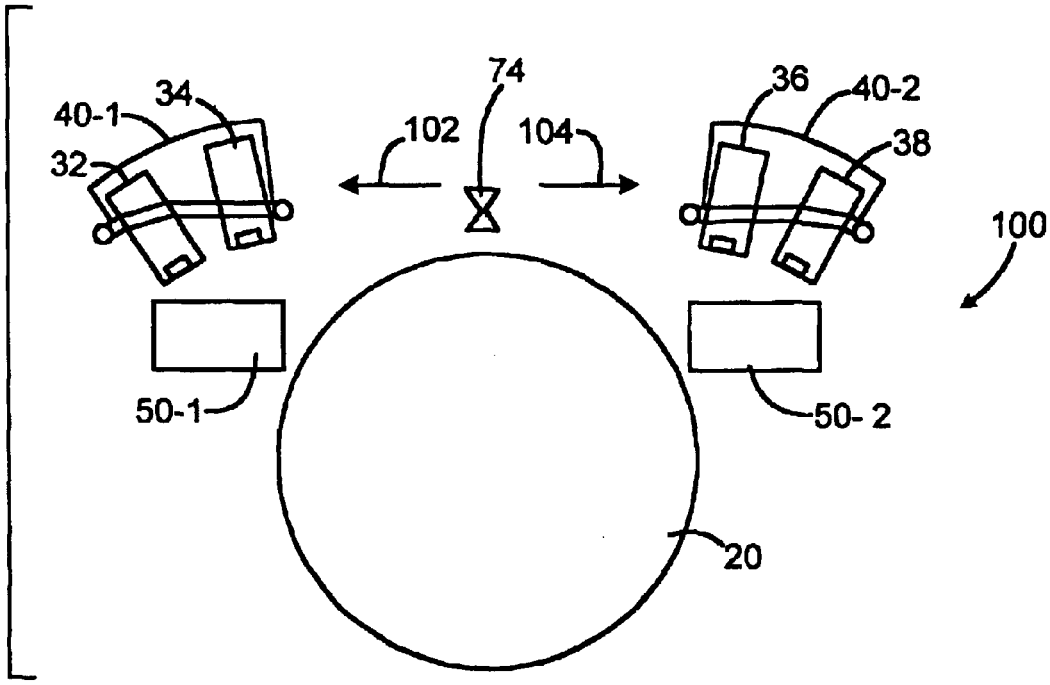
FIG. 7 is a schematic illustration of the printer of FIG. 6, with the print bars moved to respective service position.
Figure 8:
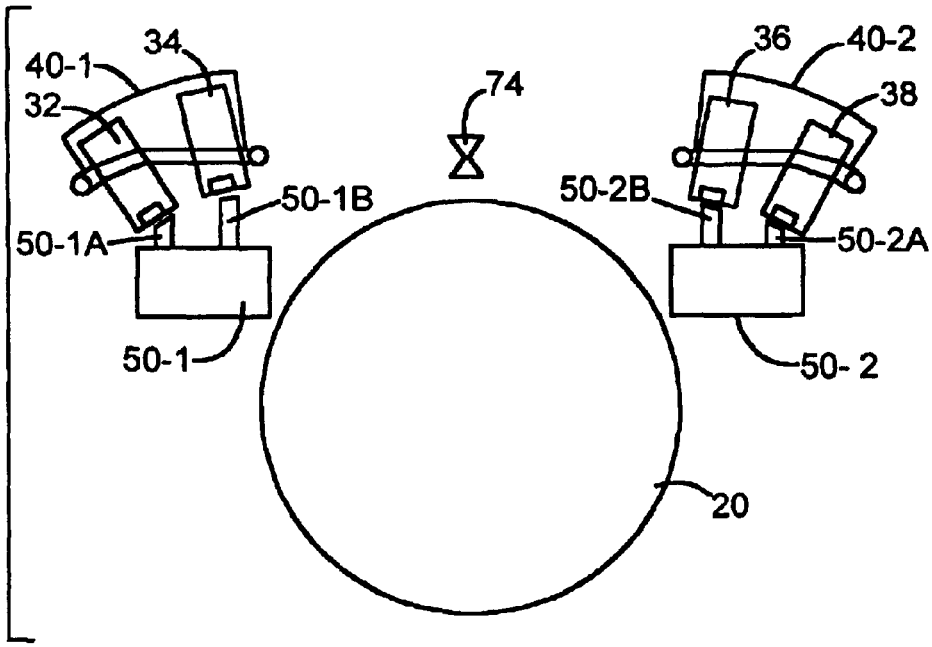
FIG. 8 is a schematic illustration of the printer as in FIG. 7, with the service station components moved to servicing positions.

Another embodiment of a service station architecture is illustrated in FIGS. 6–8. This embodiment employs a split service station architecture, wherein first and second service stations 50-1 and 50-2 are mounted in respective fixed service positions. As with the embodiment of FIGS. 1–5, this embodiment also employs a plurality of print bars 32, 34, 36, 38 disposed adjacent the drum, each comprising in this exemplary embodiment a page wide array (PWA) of printheads or pens 32A, 34A, 36A, 38A. The print bar support frame structure is split into two frame structures 40-1, 40-2. Frame structure 40-1 supports print bars 32, 34, and frame structure 40-2 supports print bars 36, 38. The frame structure 40-1 and the print bars 32, 34 are movable along a constrained linear axis 102 between a printing position (FIG. 6) and a service position (FIG. 7). The frame structure 40-2 and the print bars 36, 38 are movable along a constrained linear axis 104 between a printing position (FIG. 6) and a service position (FIG. 7). Motor driven rack and pinion gear trains can be employed to move the respective frame structures 40-1 and 40-2 along their respective linear axes. In this exemplary embodiment, the axes or paths 102, 104 are orthogonal to the drum axis 22. The print bars are arranged on the respective frame structures in a manner that, with the print bars in the printing positions, the printhead nozzle arrays are positioned in a conformal manner relative to the curved surface of the drum for printing, with a very small spacing between the nozzle array surface and the drum surface. A dual V-block registration surface structure 74 is positioned between the frame structures 40-1 and 40-2, so that ball-like datums 46-2, 48-2 on adjacent ends of the respective frame structure are engaged in the notches of the registration surface structure 74 when in the printing position. Datums 46-1, 48-1 at the distal ends of the respective frame structures are in contact with registration surfaces 76, 78 in this position. With the frame structures moved along their linear axes to the service position, the curved relationship between the adjacent printheads on the respective support frames is maintained. The datums and registration surfaces may be formed in pairs, disposed on opposite sides of the drum to register the position of each end of the frame bars, and provide clearance for motion of the service station through its range of motion.

Each service station includes service components to service the respective printheads. After the split print bars have been moved to the service position, as illustrated in FIG. 7, the service station components are actuated to move into position to service the printheads. FIG. 8 illustrates the service station components moved into the printhead service positions. For station 50-1, there are provided respective service station components 50-1A, 50-1B which are moved different distances to position the components at each printhead to clean or otherwise service the nozzle arrays of the printheads. Component 50-1A moves a smaller distance than component 50-1B. The service head of each component is angled in this exemplary embodiment to provide a proper facing relationship with the angularly oriented printhead array, due to the conformal mounting of the PWAs on the print bars. The service heads can include wipers, caps, spittoons or drop detection systems to perform wiping, capping, spitting and drop detection service functions to maintain printhead health. The printer can include a mechanism to provide relative motion between the service heads and the printheads, e.g. to provide a wipe or cap motion.

After completion of a service cycle, the service components are returned to the rest position (FIGS. 6–7), and the print bars are moved along the constrained linear paths 102, 104 to position the printheads of the print bars at the printing position (FIG. 6). Maintenance operations can be performed on the service components, e.g. a wiper can be scraped.

Figure 9:
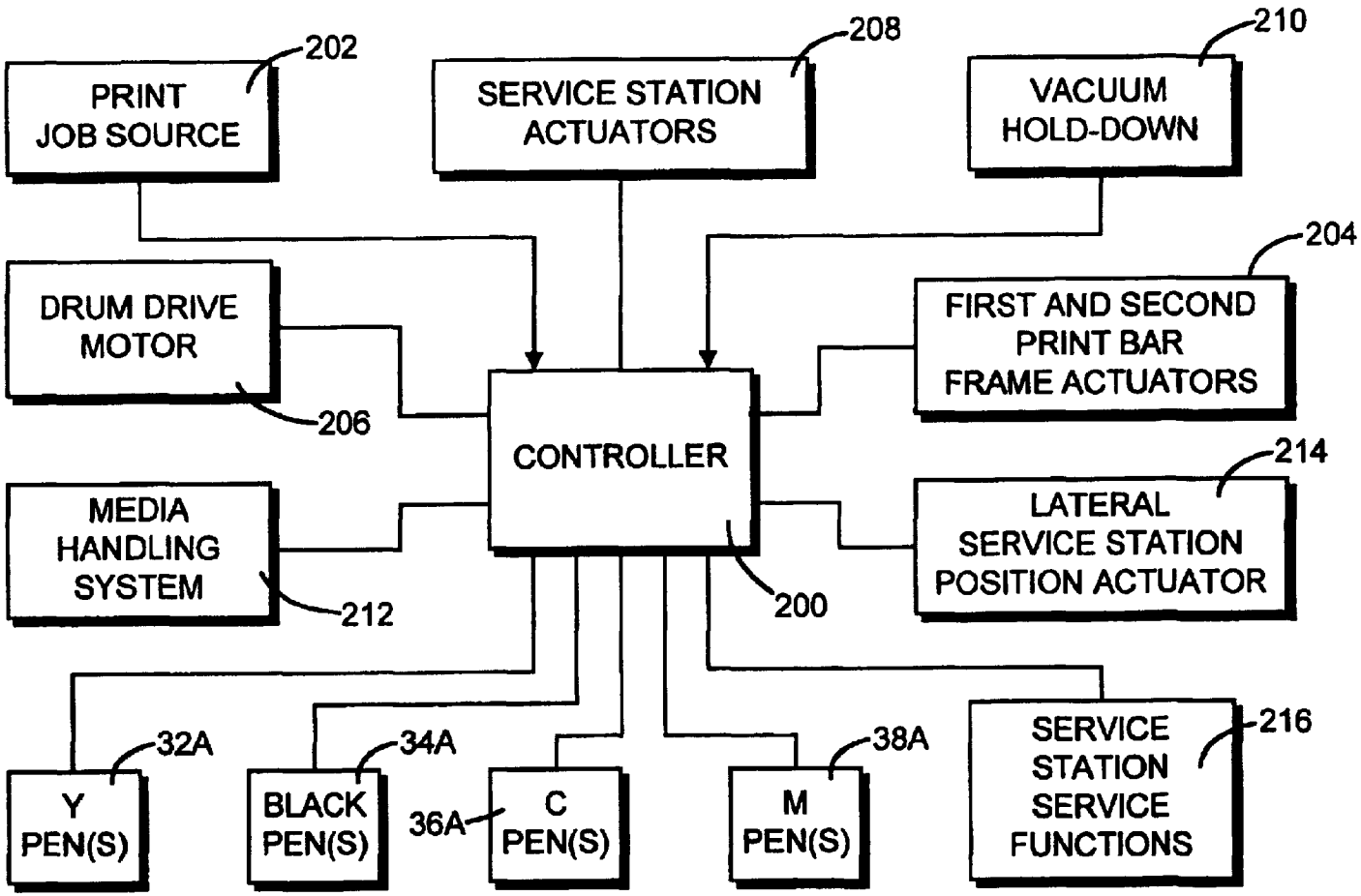
FIG. 9 is a schematic control block diagram of elements of the drum printer of FIGS. 6–8.

FIG. 9 is a schematic block diagram of the control system for the printer embodiment of FIGS. 6–8. The control system is similar to that shown in FIG. 5, except that separate first and second print bar frame actuators (shown generally as elements 204) are employed to move the split print bar frame structures along their respective linear paths. The service station actuators 208 are employed to move the service station components into position. A lateral service station position actuator provides lateral motion for wiping and capping function.

Although the foregoing has been a description and illustration of specific embodiments of the invention, various modifications and changes thereto can be made by persons skilled in the art without departing from the scope and spirit of the invention as defined by the following claims.

What is claimed is:

1. A method for servicing a printhead, the method comprising:

moving the printhead along a path away from a printing position adjacent a drum rotatable about a rotation axis to a service position away from the drum, said path orthogonal to said rotation axis;

conducting a service operation on the printhead at the service position;

moving the printhead back to the printing position to reposition the printhead adjacent the drum.

2. The method of claim 1, wherein said moving the printhead away from the printing position comprises:

moving the printhead in a rotational path.

3. The method of claim 1, wherein said moving the printhead away from the printing position comprises:

moving the printhead along a linear path.

4. The method of claim 1, wherein said conducting said service operation comprises any of wiping, capping, spitting or drop detection functions.

5. The method of claim 1, wherein said conducting said service operation comprises:

moving a service station from a rest position to a servicing position adjacent the printhead.

6. The method of claim 1, wherein said moving the printhead along the path back to the printing position includes engaging a fixed registration surface with a datum to accurately position the printhead at the printing position.

7. A method for servicing a printhead, the method comprising:

moving the printhead along an arc-shaped path away from a printing position adjacent a drum rotatable about a rotation axis to a service position away from the drum;

conducting a service operation an the printhead at the service position;

moving the printhead back to the printing position to reposition the printhead adjacent the drum.

8. The method of claim 7, wherein said moving the printhead along the path back to the printing position includes engaging a fixed registration surface with a datum to accurately position the printhead at the printing position.

9. A drum printer, comprising:

a rotatable drum having a print medium supporting surface and mounted for rotation about a rotation axis;

a printhead disposed adjacent the supporting surface, the printhead mounted on a print bar support structure; and an actuator for moving the print bar support structure along a path orthogonal to said rotation axis between a printing position and a service, position.

10. The printer of claim 9, wherein the print bar comprises a page wide array of printheads including said printhead.

11. The printer of claim 9, wherein said printhead is an inkjet printhead comprising an array of fluid ejecting nozzles.

12. The printer of claim 11, wherein the printhead nozzle array is positioned adjacent to the surface of the drum in the printing position to provide high print quality of the printed output.

13. The printer of claim 9, wherein said print bar frame structure is pivotable for rotational movement about a pivot axis, and said path is an arc.

14. The printer of claim 13, wherein said pivot axis is parallel to said rotation axis.

15. The printer of claim 9, wherein said path is a linear path.

16. The printer of claim 9, further comprising a plurality of datums for accurately registering the frame structure at the printing position.

17. The printer of claim 9, further comprising a service station for performing a service function on the printhead at the service position.

18. A method for servicing a plurality of print bars, the method comprising:

moving the plurality of print bars along a path away from a printing position to a service position away from the surface of a drum, each print bar having a page wide array of printheads thereon;

conducting a service operation on the plurality of print bars at the service position;

moving the plurality of print bars along the path back to the printing position to accurately reposition the print bars for printing operations.

19. The method of claim 18, wherein said moving the plurality of print bars away from the printing position comprises:

moving the plurality of print bars in a rotational path.

20. The method of claim 18, wherein said moving the plurality of print bars away from the printing position comprises:

moving the plurality of print bars along a linear path.

21. The method of claim 18, wherein said conducting said service operation comprises any of wiping, capping, spitting or drop detection functions.

22. The method of claim 18, wherein said conducting said service operation comprises:

moving a service station from a rest position to a servicing position adjacent the plurality of print bars.

23. The method of claim 18, wherein said moving the plurality of print bars along the path back to the printing position includes engaging a fixed registration surface with a datum to accurately position the plurality of print bars at the printing position.

24. A drum printer, comprising:

a rotatable drum having a print medium supporting surface;

a plurality of print bars disposed adjacent the supporting surface, the print bars mounted on a print bar support structure;

an actuator for moving the print bar support structure along a path between a printing position and a service position, wherein said path is a linear path.

25. The printer of claim 24, further comprising a service station for performing service functions on the print bars at the service position.

26. A drum printer, comprising:

a rotatable drum having a print medium supporting surface;

a plurality of print bars disposed adjacent the supporting surface, the print bars mounted on a print bar support structure;

an actuator for moving the print bar support structure along a path between a printing position and a service position;

a plurality of datums for accurately registering the print bar support structure at the printing position.

27. A drum printer, comprising:

a rotatable drum having a print medium supporting surface;

a plurality of print bars disposed adjacent the supporting surface, the print bars mounted on a print bar support structure;

an actuator for moving the print bar support structure along a path between a printing position and a service position, wherein said path is orthogonal to an axis of rotation of said drum.

28. A drum printer, comprising:

a rotatable drum having a print medium supporting surface;

a first set and a second set of print bars disposed adjacent the supporting surface;

the first set mounted on a first print bar support structure for movement along a first linear constrained path;

the second set mounted on a second print bar support structure, for movement along a second linear constrained path;

a first actuator for moving the first print bar support structure along said first constrained path between a first set printing position and a first set service position;

a second actuator for moving the second print bar support structure along said second constrained path between a second set printing position and a second set service position.

29. The printer of claim 28, further comprising:

a first service station for performing service functions on the first set of print bars at the first service position;

a second service station for performing service functions on the second set of print bars at the second service position.

30. The printer of claim 28, wherein each print bar comprises a page wide array of printheads.

31. The printer of claim 28, wherein each print bar comprises an inkjet printhead comprising an array of fluid ejecting nozzles.

32. The printer of claim 31, wherein each array of fluid ejecting nozzles is positioned adjacent to the surface of the drum in the printing position to provide high print quality of the printed output.

33. A drum printer, comprising:

a rotatable drum having a print medium supporting surface and mounted for rotation about an axis;

a print bar having an array of fluid ejecting nozzles mounted thereon;

print bar support means for supporting the print bar at a print position adjacent the surface at a printing position and at a service position;

means for moving the print bar support means along a path orthogonal to said axis, between the printing position and the service position.

34. The printer of claim 33, wherein said array is a page wide array of printheads.

35. The printer of claim 33, wherein the print bar comprises an inkjet printhead comprising an array of fluid ejecting nozzles.

36. The printer of claim 35, wherein the printhead nozzle array is positioned adjacent to the surface of the drum in the printing position to provide high print quality of the printed output.

37. The printer of claim 33, wherein said print bar support means is pivoted for rotational movement about a pivot axis, and said path is an arc.

38. The printer of claim 37, wherein said pivot axis is parallel to an axis of rotation of said drum.

39. The printer of claim 33, wherein said path is a linear path.

40. The printer of claim 33, further comprising datum means for accurately registering the print bar support means at the printing position.

41. The printer of claim 33, further comprising a service station for performing service functions on the print bars at the service position.

42. A method for servicing print bars, the method comprising:

moving a first set of the print bars in a first direction away from a first printing position to a first service position away from the surface of a drum, each print bar having a page wide array of printheads thereon;

moving a second set of the print bars in a second direction which is opposite said first direction, from a second printing position to a second service position;

conducting a service operation on the first set and the second set of print bars at the respective first and second service positions;

moving the first set and the second sets of print bars back to the respective first and second printing positions to accurately reposition the print bars for printing operations.

43. The method of claim 42, wherein said moving the first set of print bars away from the first printing position comprises moving the first set along a first linear path, and said moving the second set of print bars away from the second printing position comprises moving the second set along a second linear path.

44. The method of claim 43, wherein said moving the first set and the second sets of print bars back to the respective first and second printing positions includes engaging respective first and second fixed datums with respective registration surfaces.

* * * * *

UNITED STATES PATENT AND TRADEMARK OFFICE

CERTIFICATE OF CORRECTION

PATENT NO. : 6,913,341 B2
APPLICATION NO. : 10/631903
DATED : July 5, 2005
INVENTOR(S) : John A. Barinaga et al.

It is certified that error appears in the above-identified patent and that said Letters Patent is hereby corrected as shown below:

IN THE CLAIMS

Claim 7, Column 5, line 47, after "operation" delete "an" and insert therefor --on--

Claim 9, Column 5, line 62, after "service" delete ","

Signed and Sealed this

Third Day of June, 2008

JON W. DUDAS
*Director of the United States Patent and Trademark Office*